United States Patent [19]

Zanichelli

[11] 4,448,227

[45] May 15, 1984

[54] DRESSING OR PRESERVING LIQUID FILLING UNIT FOR VACUUM FILLING MACHINES

[76] Inventor: Giuseppe Zanichelli, Via Mantova, 65, Parma, Italy

[21] Appl. No.: 310,590

[22] Filed: Oct. 13, 1981

[30] Foreign Application Priority Data

Oct. 24, 1980 [IT] Italy ..... 25573 A/80

[51] Int. Cl.[3] ..... B65B 31/00

[52] U.S. Cl. ..... 141/57; 141/59; 141/147; 141/69; 137/625.46

[58] Field of Search ..... 141/1, 4–9, 141/11, 37, 39–70, 285–310, 250–284, 121, 191, 144–152, 183–190, 100–107; 137/205, 625.46

[56] References Cited

U.S. PATENT DOCUMENTS 4,369,821 1/1983 Carter ..... 141/147

*Primary Examiner*—Houston S. Bell

*Attorney, Agent, or Firm*—Guido Modiano; Albert Josif

[57] ABSTRACT

Dressing or preserving liquid filling unit for vacuum filling machines, comprising a valving member for the introduction of dressing liquid, formed by a lower body sealingly associable with a can or the like, and an upper body which is connected to the lower body and pivotable relatively thereto to take a variety of operational positions. The rotation of the upper body with respect to the lower one is accomplished through a cam following element which is connected to a rod extending axially from the upper body, which engages with a camming path correspondingly arranged along the processing path followed by cans to be filled.

7 Claims, 13 Drawing Figures

B
C
D

DRESSING OR PRESERVING LIQUID FILLING UNIT FOR VACUUM FILLING MACHINES

BACKGROUND OF THE INVENTION

This invention relates to a dressing or preserving liquid filling unit for vacuum filling and the like machines.

As is known, canned food products, such as fruit, vegetables and the like, are immersed in a liquid, commonly called "dressing liquid", which may be juice from the product itself, a product preparation liquid, syrup, a conservation liquid, and include liquids having different viscosities and liquids with solid suspensions.

In effecting this type of packaging, it is current practice to first introduce the dripped product into the can, thereafter, by means of automatic filling machines called toppers, the dressing liquid is introduced in a desired amount.

Such packaging machines are set up to carry out a given sequence of operations including the creation of a vacuum in the can intended to contain the dripped product, the filling of the can with dressing liquid—which is effected by "suction", that is through the vacuum in the can drawing in the dressing liquid from a suitably arranged dressing liquid reservoir.

After the filling step, the can is subjected to a dressing liquid topping and level adjusting step whereby the dressing liquid is brought to the exact desired level, thereafter the vacuum is removed as may be still present inside the can by placing the latter in communication with the atmosphere.

In some cases, the topping step may be omitted altogether, as being unnecessary when operating with a low temperature dressing liquid and without any risk of its tending to foam when vacuumed.

All these processing steps are carried out on carousel-type machines which are equipped with a plurality of valving elements comprising a lower body sealingly associable with a can to be filled and an upper body which is mounted pivotally above the lower body and is rotated to sequentially establish external connections, that is connections with the vacuum source and dressing liquid reservoir for carrying out the cited steps.

According to current practice, the rotation of the upper body is generally accomplished by providing an upwardly exending axial rod above the upper body which is terminated with a cross or spider element effective, during the movement of the valving elements on the carousel, to successively engage with a cam which causes, at a suitable time, a rotation by 90° or submultiple of 90° of the upper body with respect to the lower body, thus providing the transition from one processing step to the next.

This approach, while satisfactory in theory, is quite objectionable from a practical standpoint in that the rotation of the upper body relatively to the lower one, as accomplished through the spider interfering with the cam, results in a series of impacts of the spider against the cams, which produces considerable noise, which noise becomes specially annoying and even intolerable owing to the topper machines including a fairly high number of valving elements or members which are brought into operation in accordance with a continuous operating cycle, so that the noise produced by the continued impacts may be actually a deafening one.

Another problem connected with the cited means of actuation of the upper body resides in that by achieving the rotational movement through a continuous series of impacts both the cams and spiders are subjected to considerable wear, so that the machine requires continued servicing, which appreciably affects the production cycles.

A further drawback is that the continued succession of impacts unavoidably results in the separation of metal particles which may float in the air and get into the can along with the food product, which thing is obviously unacceptable.

Moreover, the completion of rotational movements between one step and the next, generally amounting to 90 degrees, of the upper body relative to the lower body, in addition to lowering the production rate owing to the transitions from one step to the next, also causes a farily appreciable amount of wear at the contact area between the lower and upper bodies, which contact must obviously occur in a tight sealed condition to prevent the escape of dressing liquid, as well as at the other elements connected to the upper body.

SUMMARY OF THE INVENTION

Accordingly the task of this invention is to obviate the foregoing drawbacks by providing a dressing liquid filling unit for vacuum filling and the like machines, which is so constructed as to produce the rotation of discrete portions of the upper body relatively to the lower body of the valving elements in a "soft" manner, that is without creating impact conditions but rather providing a short time duration rotational movement in a guided manner.

Within this task it is an object of the invention to provide a dressing liquid filling unit in which, by eliminating the succession of impacts due to the rotation of the upper body, also eliminated are all of the problems relating to the machine noise emission, as well as the considerable wearing of the component parts.

A further object of the invention is to provide such a filling unit, whereby the transition to the various processing steps can be effected with a much shorter rotation between the upper body and lower body of the valving element than conventional rotational movements.

Yet another object of the invention is to provide a dressing liquid filling unit, which while exhibiting much improved features is also simple construction-wise and of reduced and easier maintenance.

The aforesaid task and objects and yet other objects, such as will be apparent hereinafter, are all achieved by a dressing liquid filling unit for vacuum filling and the like machines, according to this invention, which comprises at least one valving element for the introduction of dressing liquid including a lower body, associable in sealed relationship with a can or the like, and an upper body being associated with and pivotable relatively to said lower body to sequentially carry out the steps of creating a vacuum in said can, filling said can with said dressing liquid, topping where required said can with said dressing liquid, and removing the vacuum from the thusly filled can, a programmed actuating means being provided for said upper body, characterized in that said programmed actuating means comprises a cam following element associated with said upper body and adapted for engagement with a camming path arranged along the processing path followed by said cans to bring said upper body cyclically into positions corresponding to said steps.

BRIEF DESCRIPTION OF THE DRAWINGS

Further features and advantages will become more apparent from the following description of a preferred but not limitative embodiment of a dressing liquid filling unit for vacuum filling and the like machines, with reference to the accompanying illustrative and not limitative drawings, where.

DESCRIPTION OF THE PREFERRED EMBODIMENTS

Figure 1:
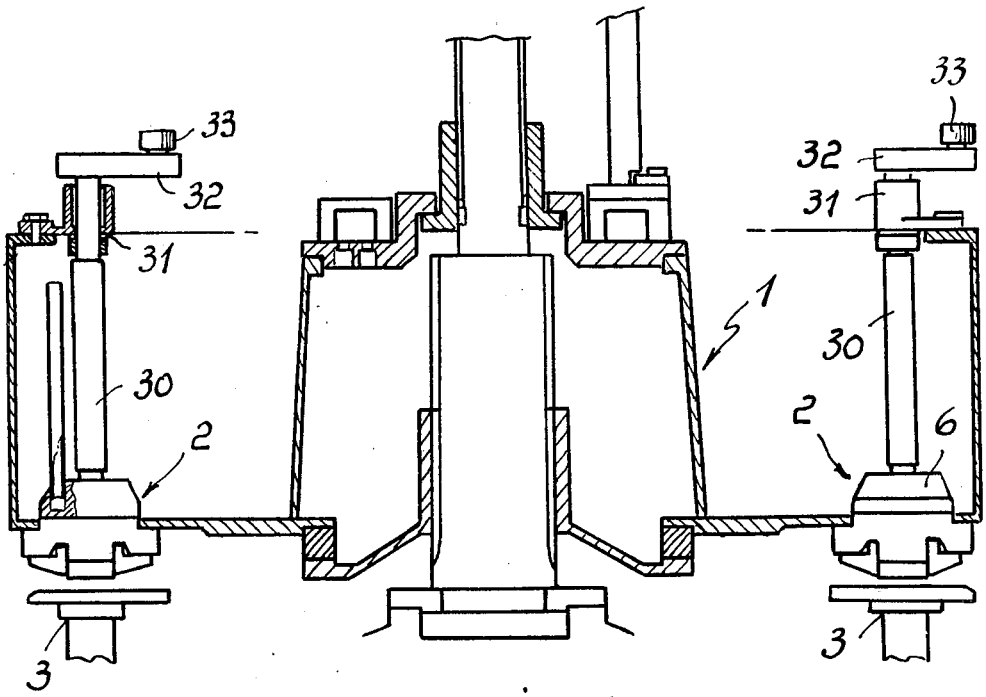
FIG. 1 illustrates schematically and in section an embodiment of a filling machine incorporating the filling units of this invention.
Figure 2:
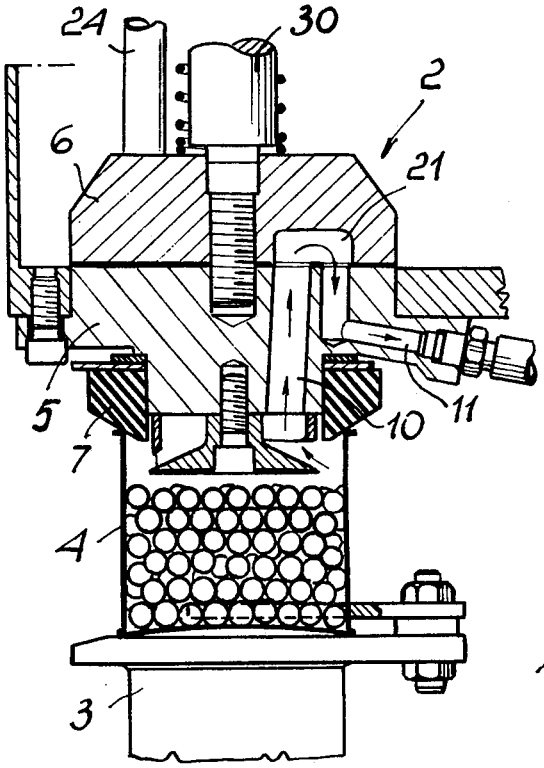
FIG. 2 is a schematical cross-sectional view of the valving element during the step of creating a vacuum within the can.
Figure 3:
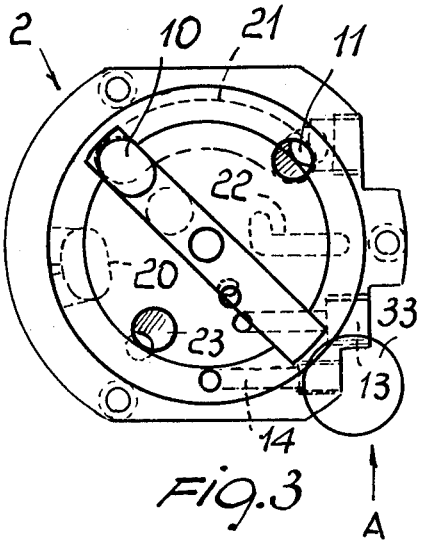
FIG. 3 is a plan view illustrating the mutual positioning of the upper body and lower body.

A topper type of filling machine incorporating the inventive dressing liquid filling unit comprises a carousel 1 rotatably carried in a base frame which has a plurality of uniformly distributed valving elements, generally indicated at 2 and being arranged in alignment with a plate 3 intended for supporting a can 4.

Each of the cited valving elements includes a lower body 5 and upper body 6 overlying and being pivotable relative to the lower body 5.

The lower body 5 is provided at the bottom with an annular seal 7 enabling its coupling in sealed relationship with the top mouth of the can 4 as carried on its corresponding plate 3.

The cited lower body defines on its interior a main channel 10 open to the lower face of the body 7 and accordingly to the interior of the can 4, after the body 5 has been applied to the can, while the main channel 10 opens at the top to the flat upper face of the body 5.

Also inside the body 5, a suction channel 11 is defined which communicates to a vacuum source and to the upper face of the body 5. In the body 5, there is further defined an auxiliary channel 12 open with its ends to the lower face and upper face, respectively, of the body 5, as well as an auxiliary air intake channel 13, also connected to a vacuum source.

In the body 5, there is also provided a compressed air delivery conduit 14, which opens to the upper face of the body 5 and communicates to a source of compressed air.

In the upper body 6, there are defined a dressing liquid delivery channel 20 which opens to the flat lower face of the upper body 6, a main connection channels 21 communicating together, as will be explained hereinafter, various channels of the body 5, an auxiliary connection channel 22, and a bleeding channel 24 which communicates to the outside atmosphere to restore atmospheric pressure conditions within the can 4.

Form the upper body 6, there extends axially a rod 30 which is journalled, at the top portion thereof, in a sleeve 31 rigidly connected to the carousel 1.

The rod 30 is provided, at its free end, with an arm 32 which carries a cam following element, advantageously in the form of a roller 33.

The cited roller 33 engages with a camming path provided by tracks 34 formed on plates 35 which are arranged to match the path followed by the can 4 and consequently by the various valving elements 2 during the various filling steps.

The cited plates 35 are arranged only at those areas where the roller 33 is to change its path, which change of path is implemented by a rotation of the upper body 6 with respect to the lower body 5.

The exclusive provision of the camming path along those portions where a change of position of the roller 33 is to occur results from the centrifugal force which acts on the arm 32 being insufficient to overcome the frictional resistance which develops between the rod 30 and sleeve 31 and the force resulting from the negative pressure which develops between the contacting surfaces of the bodies 5 and 6.

The provision of a programmed actuation means for the cited upper body, which comprises a roller 33 and track 34, enables the reaching of the various positions corresponding to the processing steps just described without any impacts, as was instead the case with conventional machines, and progressively, i.e. the displacement, in the direction of rotation of the upper body with respect to the lower body, is effected through the roller moving along the camming path, which is located offcentered with respect to the axis of the rod 30, thereby any displacement of the camming path in the radial direction of translation of the various valving elements reflects in a relative rotational movement of the upper body 6 with respect to the lower body 5.

Another important aspect of the invention is that the transition to the various positions, corresponding to the various processing steps, occurs through a first 90° rotation in one direction and three successive rotational movements in the opposite direction of the upper body 6 with respect to the lower body, which will correspond to a 90° overall rotation practically bringing the valving element back to its initial condition.

Figure 12:
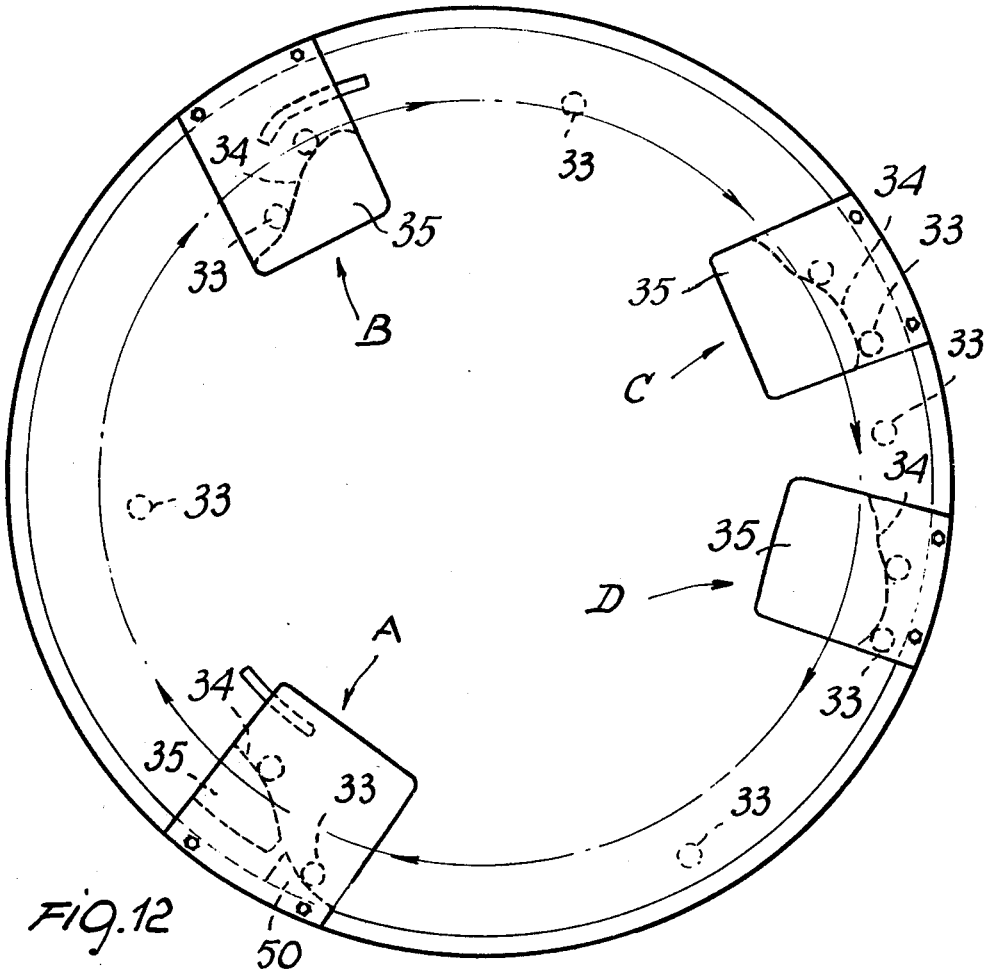
FIG. 12 is a schematical plan view of the layout of the various camming paths for transition to the various processing steps.
Figure 11:
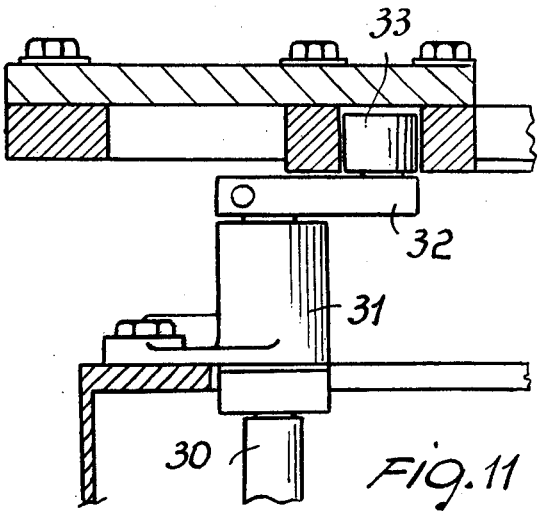
FIG. 11 is a sectional view of the coupling between the cam following element and the camming path.

A more detailed discussion of the operation of the filling unit according to the invention would show that during the first processing step, which corresponds to the creation of a vacuum within the can, the roller 33, by performing a 90° rotation in a direction imparted by the plate A thereto, moves into the position it will maintain in the region between A and B (FIG. 12).

With the roller 33 in this position, the main connection channel 21 will communicate together the channel 10 and channel 11 connected to a vacuum source, thereby a vacuum is formed within the can.

Upon completion of the vacuum forming step, the roller 33 is started along the track 34 of the plate as located at position B, thereby it causes the upper body to rotate relatively to the lower body, the rotational movement in question being approximately equal, in the present embodiment, to 47° in the opposite direction. In this position, the channel 10 is placed in communication with the channel 20 delivering the dressing liquid, which liquid is thus practically drawn into the can 4.

Figures 4, 5, 6, 7, 8, 9, 10:
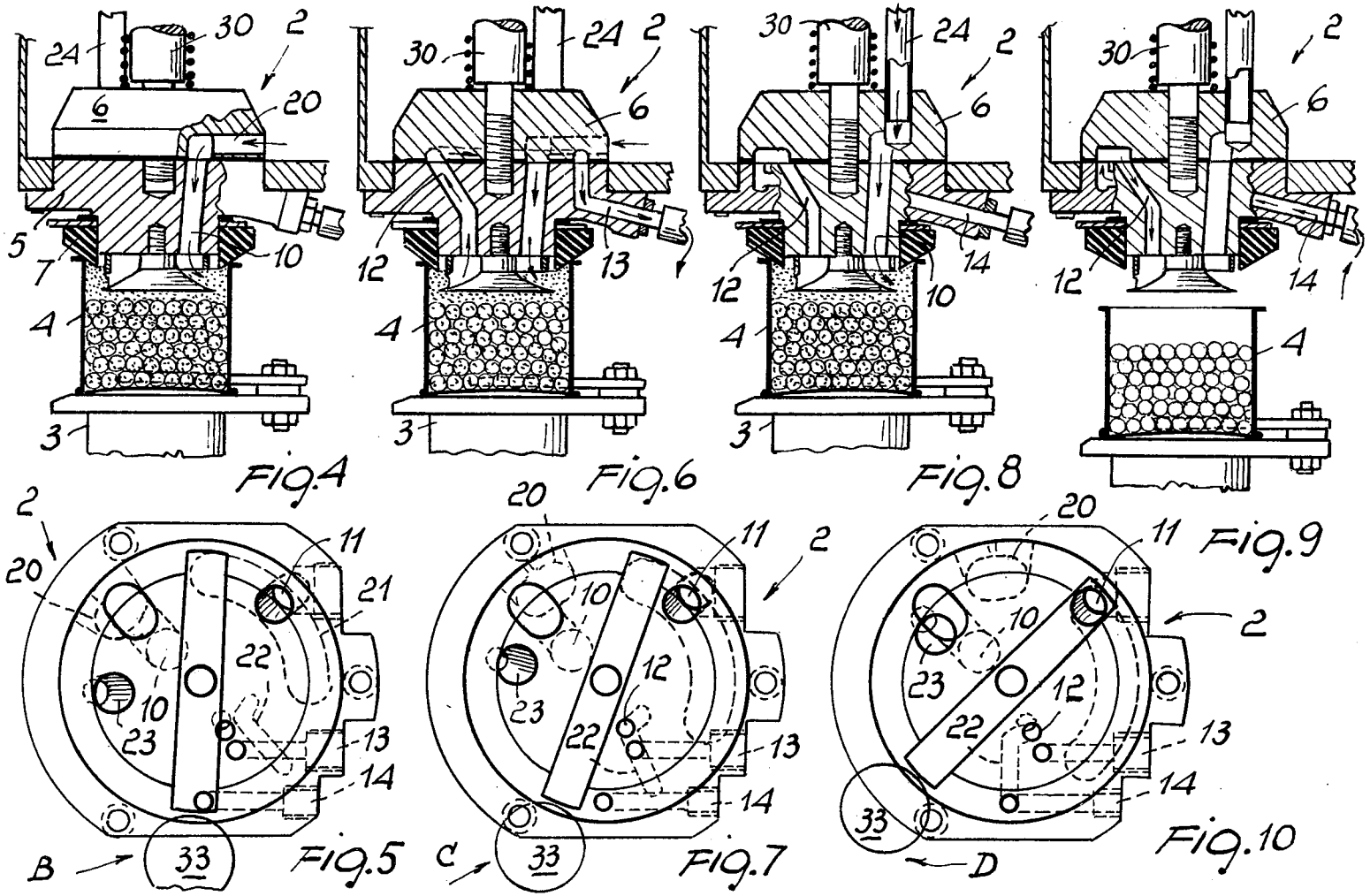
FIG. 4 is a cross-sectional view of the valving element during the filling step.
FIG. 5 illustrates in plan view the mutual positioning of the upper and lower bodies.
FIG. 6 is a cross-sectional view of the valving element during the topping step.
FIG. 7 illustrates in plan view the mutual positioning of the upper and lower bodies during the optional topping step.
FIG. 8 is a cross-sectional view of the valving element during the vacuum removal step.
FIG. 9 is a cross-sectional view of the valving element during the bleeding step.
FIG. 10 illustrates the mutual positioning of the upper and lower bodies during the vacuum removal and bleeding steps.

This position is more clearly illustrated in FIG. 5, where the roller is represented in the position it takes upon leaving the plate B.

After completing the dressing liquid filling step, which corresponds to the region included between B and C, the roller 33 contacts the track 34 of the plate 34, as occupying the position C, so that the upper body 6 will perform, under the action of the roller 33, a rotational movement, amounting to 18 degrees, again in the same direction of rotation as imparted to it at B, with respect to the lower body; in this position, as shown more clearly in FIG. 7, the channel 10 still communicates to the dressing liquid delivery channel 20, whereas the auxiliary channel 12 of the lower body 5 communicates to the air suction channel 13 through the auxiliary connection channel 22. During this step, which is included between C and D, the suction exerted on the can interior by the channel 12 will remove from the can any residual air as well as the foam formed during the filling operation, thereby a negative pressure is established which draws dressing liquid into the can. During this step, there occurs a continued replacement of fresh product with that already contained in the can, which is evacuated along with any small amount of air still present therein. The drawing of liquid product is effected through passageways 12, which may be made smaller than the delivery ones 10, to thus make certain that less liquid product is removed than can be added.

Upon completion of this step, as the carousel continues to rotate, the roller 33 contacts the track 34 of the cam 34, as indicated at position D in FIG. 12, and the engagement of the roller with the path 34 in this position produces a further rotation, which is estimated to correspond to 25 degrees in this specific embodiment and to occur always in the same direction, thereby the upper body moves into the position shown in FIGS. 8 and 9; in this position, the channel 10 communicates with the bleeding channel 24 and places the can interior in communication with the surrounding atmosphere the pressure whereof will remove the vacuum from within the can, thus performing a vacuum breaking step.

Moreover, the auxiliary connection channel 22 places the channel 12 in communication with the compressed air inlet channel 14 admitting compressed air into the channel 12 to remove any particles of dressing liquid still extent.

During the vacuum breaking step, the plate 3 carrying the can is moved away from its corresponding valving element 2, the step of introducing the dressing liquid being over.

The bleeding step is carried out subsequently to the vacuum braking step and in the proximity of the cam A, so that any residual particles are allowed to fall into a fresh can to avoid fouling the machine and a waste of product. The vacuum breaking and bleeding steps occur in the region between D and A.

It should be noted that in the transitions between the various processing steps, the upper body undergoes, relatively to the lower body, an initial rotation by 20° in one direction and three successive rotations in the opposite direction which amount to an overall rotation by 90°.

Upon completion of the cycle just described, the roller 33 will present itself back to the inlet end of the cam A, and the cycle will be repeated in exactly the same manner as described hereinabove.

Figure 13:
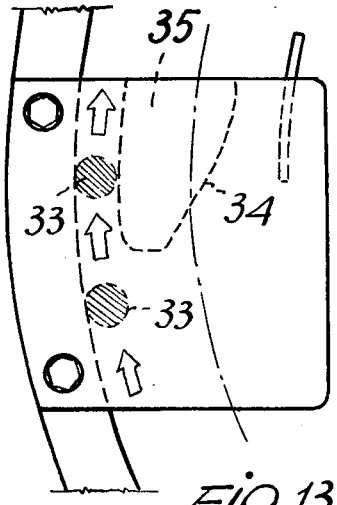
FIG. 13 shows schematically the positioning of the first cam as a container is missing.

It should be further noted that the machine is equipped with a safety device, known per se, which inhibits the carrying out of the various processing steps where no can happens to be present. Said device comprises a movable cam 50 located at the start of the cam A which in the presence of a can will arrange itself as shown in FIG. 12, whereas in the absence of a can will retracts as shown in FIG. 13, thereby the roller 33 follows an outer path without interfering with the various cams and causing any relative rotations of the lower and upper bodies.

It will be appreciated from the foregoing that the invention achieves its objects, and in particular that the provision of actuating means comprising a roller 33 which engages with camming paths so implemented as to provide instantaneous rotational movements of the upper body with respect to the lower body in a continuous manner, that is without shocks, radically eliminates all of the aforesaid problems, in that no impacts are generated which in addition to an annoying noise would also bring about, as mentioned above, serious wear problems as well as problems of emission of metal dust in the environment air.

Furthermore, by limiting the relative rotation of the upper body and lower body to a total of 90° in one direction and 90° in the opposite one, friction wear between the mating surfaces of the lower body 5 and upper body 6 is also reduced, with attendant improved seal between said bodies and improved and more reliable operation of the machine as a whole.

The invention is susceptible to many modifications and variations without departing from the scope of the instant inventive concept.

Moreover, all of the details may be replaced with other technically equivalent elements.

In practicing the invention, the materials employed, if compatible with the intended use, and the dimensions and contingent shapes may be any ones suitable for the individual application.

I claim:

1. A dressing or preserving liquid filling unit for vaccum filling and the like machines, comprising a carousel, at least one valving element for the introduction of dressing liquid in cans and the like containers, said at least one valving element being carried on said carousel and including a lower body, associable in sealed relationship with one said container, and an upper body overlying and pivotable relatively to said lwoer body to sequentially carry out the steps of creating a vaccum in said container, filling said container with said dressing liquid, topping, where required, said container with said dressing liquid, and removing the vacuum from the thusly filled container, programmed actuating means being provided for said upper body, wherein, according to the improvement, said programmed actuating means comprise a cam following element carried by said upper body and a fixed camming path arranged above a processing path followed by said containers and engaged by said cam following element to bring said upper body cyclically into positions corresponding to said steps.

2. A dressing or preserving liquid filling unit according to claim 1, wherein said cam following element comprises a roller rotatably journaled on an arm rigid with a top end of a rod extending vertically and axially from said upper body.

3. A dressing or preserving liquid filling unit according to claim 1, wherein said cam following element comprises a roller rotatably journaled on an arm rigid with a top end of a rod extending vertically and axially from said upper body, said rod extending through sleeves rigid with said carousel carrying said at least one valving element.

4. A dressing or preserving liquid filling unit according to claim 1, wherien said camming path comprises tracks formed on plates located at transition areas from one processing step to the next.

5. A dressing or preserving liquid filling unit according to claim 1, wherein a transition through said processing steps is achieved by a 90° rotation about a vertical axis in one direction followed by three successive rotations in an opposite direction of said upper body with respect to said lower body to complete a combined 90- degree rotation back to an initial position.

6. A dressing or preserving liquid filling unit accord ing to claim 1, wherein said lower body has an upper face facing said upper body and a lower face, a main channel opening to the lower face and upper face thereof, an auxiliary channel opening to the lower face and upper face thereof, a suction channel communicating to a vacuum source and opening to the upper face of said lower body, an auxiliary suction channel opening to the upper face of said lower body and communicating to a vacuum supply source, and a compressed air delivery conduit opening to the upper face of said lower body.

7. A dressing or preserving liquid filling unit according to claim 6 wherein said upper body comprises a dressing liquid delivery channel open to a lower face of said upper body, a main connection channel for selectively placing in communication said main channel with said suction channel, of said lower body, and an auxiliary connection channel for selectively placing in communication said auxiliary channel with said auxiliary suction channel and said compressed air delivery channel, there being further provided a bleeding channel communicating to a surrounding atmosphere and open to the lower face of said upper body.

* * * * *